US007379033B2

(12) United States Patent
Lee et al.

(10) Patent No.: US 7,379,033 B2
(45) Date of Patent: May 27, 2008

(54) PLASMA DISPLAY DEVICE AND DRIVING METHOD OF PLASMA DISPLAY PANEL

(75) Inventors: Jun-Young Lee, Suwon-si (KR); Jin-Sung Kim, Suwon-si (KR); Jung-Keun Ahn, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 629 days.

(21) Appl. No.: 10/953,337

(22) Filed: Sep. 30, 2004

(65) Prior Publication Data

US 2005/0116887 A1 Jun. 2, 2005

(30) Foreign Application Priority Data

Nov. 28, 2003 (KR) ..... 10-2003-0085481

(51) Int. Cl.
*G09G 3/28* (2006.01)

(52) U.S. Cl. ..... 345/60; 313/169.3

(58) Field of Classification Search ..... 315/169.3; 345/60

See application file for complete search history.

(56) References Cited

U.S. PATENT DOCUMENTS 4,866,349 A 9/1989 Weber et al.
5,081,400 A 1/1992 Weber et al.
2002/0030642 A1* 3/2002 Huang et al. ..... 345/60
2003/0057854 A1* 3/2003 Roh ..... 315/169.3
2004/0257304 A1* 12/2004 Yamamoto et al. ..... 345/60

FOREIGN PATENT DOCUMENTS

KR 1020000023483 4/2000

OTHER PUBLICATIONS

Novel Energy Recovery Circuits for the AC-Driving of Capacitive Load and Application for Full-Bridge DC-DC Coverter, Seoul National University Library, pp. 1-169, Feb. 2003.

* cited by examiner

*Primary Examiner*—Amare Mengistu
*Assistant Examiner*—Yuk Chow
(74) *Attorney, Agent, or Firm*—H.C. Park & Associates, PLC

(57) ABSTRACT

In an energy recovery circuit of a plasma display panel, after storing energy in the inductor, the panel capacitor is charged by using a resonance and the stored energy. A first time period during which energy is stored in the inductor before discharging the panel capacitor is longer than a second time period during which energy is stored in the inductor before charging the panel capacitor, so that a voltage higher than half of the sustain-discharge voltage is charged to the energy recovery capacitor. In addition, the first time period of the case in which the load ratio is low is shorter than the first time period of the case in which the load ratio is high, so that the thermal stress applied to the energy recovery circuit may be reduced.

27 Claims, 11 Drawing Sheets

PLASMA DISPLAY DEVICE AND DRIVING METHOD OF PLASMA DISPLAY PANEL

PRIORITY CLAIMS TO RELATED APPLICATIONS

This application claims the benefit of Korean Patent Application Number 10-2003-0085481 filed on Nov. 28, 2003. The contents of which are incorporated herein by reference in their entirety.

BACKGROUND OF THE INVENTION

1. Field of the Invention

The present invention relates to a driving method of a plasma display panel (PDP), and a plasma display device. More specifically, the present invention relates to an energy recovery circuit of the PDP.

2. Background Description

A PDP is a flat panel display that uses plasma generated by gas discharge to display characters or images. It includes, depending on its size, more than several scores to millions of pixels arranged in a matrix pattern. Such a PDP is classified as a direct current (DC) type or an alternating current (AC) type according to its discharge cell structure and the waveform of the driving voltage applied thereto.

The DC PDP has electrodes exposed to a discharge space to allow DC to flow through the discharge space while the voltage is applied, and thus requires a resistance for limiting the current. To the contrary, the AC PDP has electrodes covered with a dielectric layer that forms a capacitor to limit the current and protect the electrodes from the impact of ions during discharge. Thus, the AC PDP generally has a longer lifetime than the DC PDP.

FIG. 1 is a partial perspective view of an AC PDP.

Pairs of scan electrodes 4 and sustain electrodes 5 are arranged in parallel on a first glass substrate 1 and are covered with a dielectric layer 2 and a protective layer 3. On a second glass substrate 6, a plurality of address electrodes 8 covered with an insulating layer 7 are arranged. Barrier ribs 9 are formed in parallel with the address electrodes 8 on the insulating layer 7, which is interposed between the address electrodes 8. A fluorescent material 10 is formed on the surface of the insulating layer 7 and on both sides of the barrier ribs 9. The first and second glass substrates 1 and 6 are arranged face-to-face with a discharge space 11 formed therebetween, and the scan electrodes 4 and the sustain electrodes 5 lie normal to the address electrodes 8. The discharge space at the intersection between the address electrode 8 and the pair of scan electrode 4 and sustain electrode 5 forms a discharge cell 12.

FIG. 2 shows an arrangement of electrodes in the PDP.

The PDP has a pixel matrix consisting of mxn discharge cells (or pixels). In the PDP, address electrodes A1 to Am are arranged in columns, and scan electrodes Y1 to Yn and sustain electrodes X1 to Xn are alternately arranged in rows. The discharge cell 12 shown in FIG. 2 corresponds to the discharge cell 12 in FIG. 1.

In general, a single frame is divided into a plurality of subfields, and the subfields are driven in the AC PDP. Each subfield includes a reset period, an address period, and a sustain period with respect to temporal operation variations.

The reset period is for initiating the status of each cell to facilitate the addressing operation. The addressing period is for selectively turning cells on and off and applying an address voltage to the turned on cells (i.e., addressed cells) to accumulate wall charges. The sustain period is for applying sustain pulses and causing a sustain-discharge for displaying an image on the addressed cells.

The discharge spaces between the scan and sustain electrodes and between the address electrode side and the scan/sustain electrode side act as a capacitance load (hereinafter, referred to as "panel capacitor"), so capacitance exists on the panel. Due to the capacitance of the panel capacitor, a reactive power is needed so as to apply a waveform for the sustain-discharge. Thus the PDP driver circuit includes a power recovery circuit for recovering the reactive power and reusing it.

An example of such a power recovery circuit is described in U.S. Pat. Nos. 4,866,349 and 5,081,400 issued to L. F. Weber.

This circuit repeatedly transfers energy of the panel to a power recovery capacitor or transfers energy stored in the power recovery capacitor to the panel using a resonance between the panel capacitor and the inductor, thus recovering the effective power. In this circuit, however, the rising/falling time of the panel voltage is dependent upon the time constant LC determined by the inductance L of the inductor and the capacitance C of the panel capacitor. The rising time of the panel voltage is equal to the falling time because the time constant LC is constant. For a faster rising time of the panel voltage, the switch coupled to the power source has to be hard-switched during the rise of the panel voltage, in which case stress on the switch increases. The hard-switching operation also causes a power loss and increases the effect of electromagnetic interference (EMI).

SUMMARY OF THE INVENTION

The present invention provides a driving method of a PDP that allows zero-voltage switching despite the parasitic components of the actual circuit, and allows a stable discharge.

In one aspect of the present invention, a plasma display device which includes a plurality of first electrodes and a plurality of second electrodes is provided, and a panel capacitor is formed by the first electrode and the second electrode. The plasma display device includes a first driver including a first inductor and a second inductor having a first ends coupled to the first electrodes, and applying a first voltage and a second voltage to the first electrodes in turn and a controller calculating a load ratio from video signals and controlling an operation of the first driver. The first driver applies the first voltage to the first electrodes after raising the voltage of the first electrodes through the first inductor, supplies an energy to the second inductor during a first time period while maintaining the first electrodes at the first voltage, and applies the second voltage to the first electrodes after reducing the voltage of the first electrodes through the second inductor to which the energy is supplied. The controller allows the first time period of the case in which the load ratio is less than the predetermined value to be shorter than the first time period of the case in which the load ratio is more than the predetermined value.

In another aspect of the present invention, a plasma display device is provided having a panel including a plurality of first electrodes and a plurality of second electrodes, and a panel capacitor being formed by the first electrode and the second electrode. In addition, the device includes a first driver applying a first voltage and a second voltage to the first electrodes in turn and a controller calculating a load ratio from video signals and controlling an operation of the first driver. The first driver includes: at least one inductor having a first end coupled to the first electrodes, a first switch coupled between the first electrode and a first voltage source supplying the first voltage, a second switch coupled between the first electrode and a second voltage source supplying the second voltage, a capacitor; and at least one third switch coupled between a second end of the inductor and a first end of the capacitor, or between a first end of the inductor and the first electrodes. The controller sets a time period, where the first switch and the third switch are both turned on when a load ratio is lower than a predetermined value, to be shorter than a time period where the first switch and the third switch are both turned on when the load ratio is higher than the predetermined value.

In still another aspect of the present invention, a driving method of a plasma display panel which includes a plurality of first electrodes and a plurality of second electrodes is provided, and a panel capacitor is formed by the first electrode and the second electrode. The driving method includes charging the panel capacitor through a first inductor coupled to the first electrodes, applying a first voltage to the first electrodes, supplying a current to a second inductor coupled to the first electrodes during a first time period while maintaining the first electrodes at the first voltage, discharging the panel capacitor through the second inductor, and applying a second voltage to the first electrodes. The first time of the case in which the number of the discharge cells to be turned on is less than the predetermined value is shorter than the first time period of the case in which the number of the discharge cells to be turned on is more than the predetermined value.

In still another aspect of the present invention, a plasma display device, which includes a plurality of first electrodes and a plurality of second electrodes, and a panel capacitor being formed by the first electrode and the second electrode, includes a mechanism that acts to apply a first voltage and a second voltage to the first electrodes in turn and a mechanism that acts to calculate a load ratio from video signals and controlling an operation of the first driver. The mechanism that acts to apply the first voltage applies the first voltage to a first electrodes after raising the voltage of the first electrodes through a first inductor, supplies an energy to a second inductor during a first time period while maintaining the first electrodes at the first voltage, and applies the second voltage to the first electrodes after reducing the voltage of the first electrodes through the second inductor to which the energy is supplied. The mechanism that acts to calculate allows the first time period of the case in which the load ratio is less than the predetermined value to be shorter than the first time period of the case in which the load ratio is more than the predetermined value.

An additional exemplary embodiment of the invention provides a plasma display device including a panel including a plurality of first electrodes and a plurality of second electrodes, and a panel capacitor being formed by a first electrode and a second electrode, a mechanism that acts to apply a first voltage and a second voltage to the first electrodes in turn and mechanism that acts to calculate a load ratio from video signals and controlling an operation of the first driver. The mechanism that acts to calculate sets a time period, where the first switch and the third switch are both turned on when a load ratio is lower than a predetermined value, to is be shorter than a time period where the first switch and the third switch are both turned on when the load ratio is higher than the predetermined value.

DETAILED DESCRIPTION

In the following detailed description, exemplary embodiment of the invention have been shown and described to illustrate the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Hereinafter, a plasma display device and a driving method for a PDP, according to an exemplary embodiment of the present invention, will be described in detail with reference to the accompanying drawings.

Figure 1:
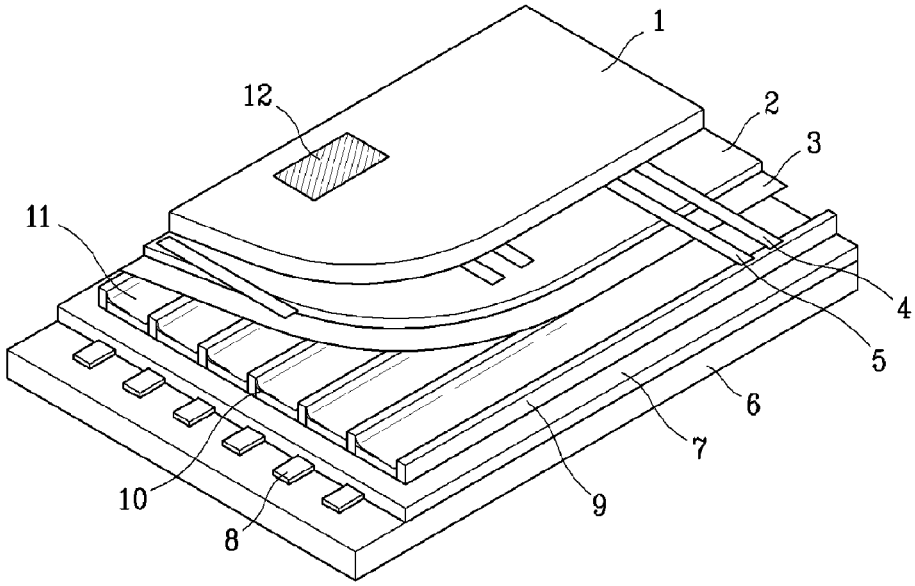
FIG.1(Prior Art)
FIG. 1 is a partial perspective view of an AC PDP.
Figure 2:
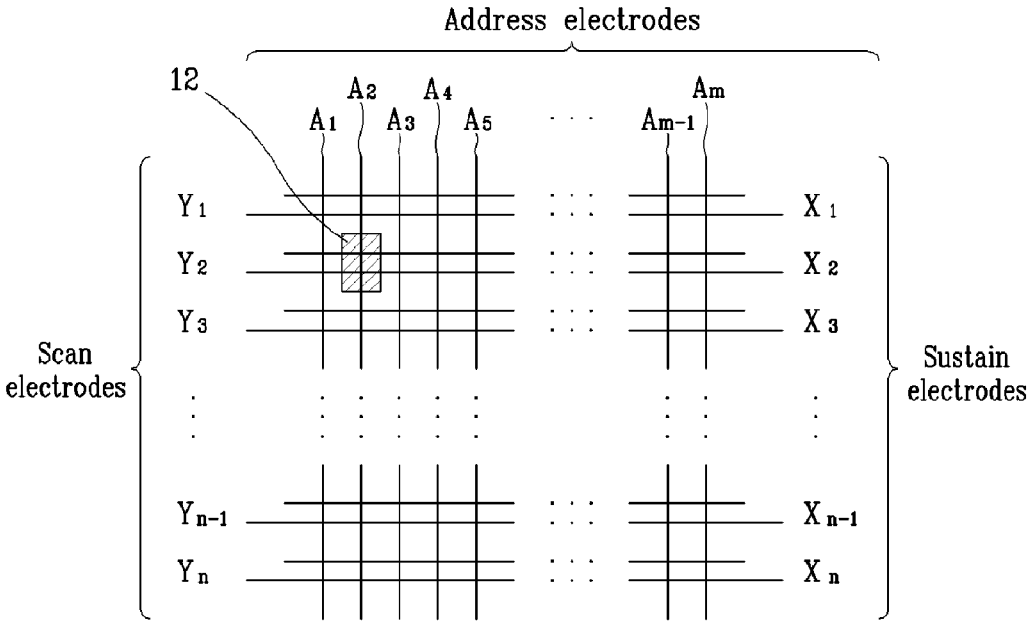
FIG.2(Prior Art)
FIG. 2 shows an arrangement of electrodes in the AC PDP.
Figure 3:
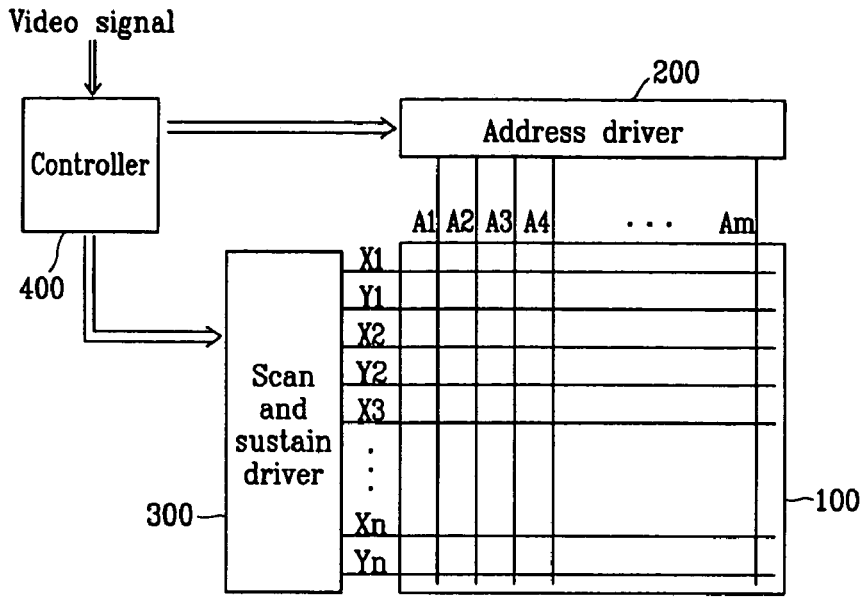
FIG. 3 is a schematic block diagram of a plasma display device according to an exemplary embodiment of the present invention.

FIG. 3 is a schematic block diagram of a plasma display device according to an exemplary embodiment of the present invention. The plasma display device according to the exemplary embodiment of the present invention includes, as shown in FIG. 1, a plasma display panel 100, an address driver 200, a scan/sustain driver 300, and a controller 400.

The plasma display panel 100 includes a plurality of address electrodes A1 to Am extended in the column direction, and a plurality of scan electrodes (hereinafter referred to as "Y electrodes") Y1 to Yn and sustain electrodes (hereinafter referred to as "X electrodes") X1 to Xn alternately extended in the row direction. The X electrodes X1 to Xn are formed in correspondence to the Y electrodes Y1 to Yn, respectively. The controller 400 receives external video signals, generates an address drive control signal and a sustain control signal, and applies the generated control signals to the address driver 200 and the scan/sustain driver 300, respectively.

The address driver 200 receives the address drive control signal from the controller 400, and applies a display data signal to each address electrode for selection of a discharge cell to be displayed. The scan/sustain driver 300 receives the sustain control signal from the controller 400, and applies sustain pulses alternately to the Y and X electrodes. The applied sustain pulses cause a sustain-discharge on the selected discharge cells.

The energy recovery circuit of the scan/sustain driver 300 according to a first exemplary embodiment of the present invention will be described in detail with reference to FIG. 4.

Figure 4:
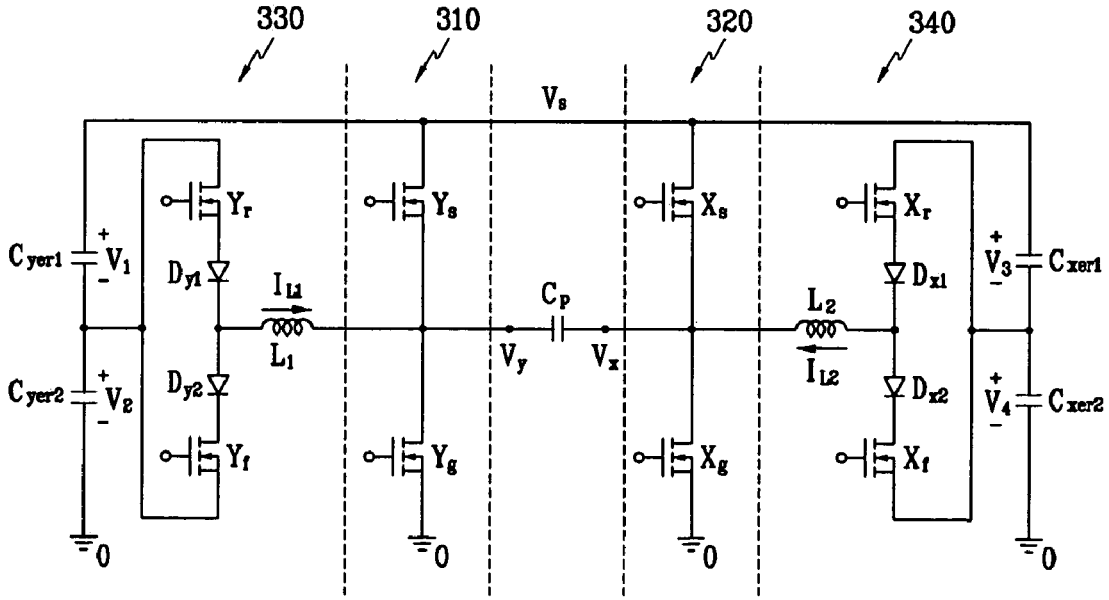
FIG. 4 is a schematic circuit diagram of an energy recovery circuit according to a first exemplary embodiment of the present invention.

FIG. 4 is a schematic circuit diagram of an energy recovery circuit according to the first exemplary embodiment of the present invention.

The energy recovery circuit according to the first exemplary embodiment of the present invention includes, as shown in FIG. 4, a Y electrode sustain unit 310, an X electrode sustain unit 320, a Y electrode charge/discharge unit 330, and an X electrode charge/discharge unit 340. An X electrode and a Y electrode are represented as a panel capacitor Cp connected between the Y electrode sustain unit 310 and the X electrode sustain unit 320.

The Y electrode sustain unit 310 includes switches Ys and Yg, and the X electrode sustain unit 320 includes switches Xs and Xg. The Y electrode charge/discharge unit 330 includes an inductor L1, switches Yr and Yf, and energy recovery capacitors Cyer1 and Cyer2. The X electrode charge/discharge unit 340 includes an inductor L2, switches Xr and Xf, and energy recovery capacitors Cxer1 and Cxer2. In FIG. 4, switches Ys, Yg, Xs, Xg, Yr, Yf, Xr, and Xf are depicted as n channel MOSFETs having a body diode formed in the direction of from the source to the drain, but may be any other switches that satisfy the following functions.

A first end (such as the drain) of the switch Ys and a first end (such as the drain) of the switch Xs are connected to a voltage source supplying a sustain-discharge voltage Vs. When the voltage difference between the X electrode and the Y electrode of the discharge cell selected in the address period is the sustain-discharge voltage Vs, the sustain-discharge occurs between the X electrode and the Y electrode of the discharge cell selected. A second end (such as the source) of the switch Ys and a first end (the drain) of the switch Yg are connected to the Y electrode, and a second end (such as the source) of the switch Xs and a first end (the drain) of the switch Xg are connected to the X electrode. A second end (such as the source) of the switch Yg and a second end (such as the source) of Xg are connected to a ground voltage of about 0V. The switching operations of these four switches Ys, Yg, Xs, and Xg allow the Y and X electrode voltages Vy and Vx of panel capacitor Cp to be maintained at the sustain-discharge voltage Vs or the ground voltage of about 0V.

A first end of the capacitor Cyer1 is connected to the voltage source supplying the sustain-discharge voltage Vs, and a second end of the capacitor Cyer1 is connected to a first end of the capacitor Cyer2. A second end of the capacitor Cyer2 is connected to the ground voltage. A first end of the inductor L1 is connected to the Y electrode. A first end (such as the drain) of the switch Yr is connected to the first end of the capacitor Cyer2, and a second end (such as the source) of the switch Yr is connected to a second end of the inductor L1. A first end (such as the drain) of the switch Yf is connected to the second end of the inductor L1, and a second end (such as the source) of the switch Yf is connected to the first end of the capacitor Cyer2. In addition, the Y electrode charge/discharge unit 330 may further include diodes Dy1 and Dy2 for preventing a current path possibly formed by the body diodes of the switches Yr and Yf, respectively. The diode Dy1 is formed on the path of the first end of the capacitor Cyer2, the switch Yr, and the second end of the inductor L1, while the diode Dy2 is formed on the path of the second end of the inductor L1, the switch Yf, and the first end of the capacitor Cyer2.

Likewise, a first end of the capacitor Cxer1 is connected to the sustain-discharge voltage Vs, and a second end of the capacitor Cxer1 is connected to a first end of the capacitor Cxer2. A second end of the capacitor Cxer2 is connected to the ground voltage. A first end of the inductor L2 is connected to the X electrode. A first end (such as the drain) of the switch Xr is connected to the first end of the capacitor Cxer2, and a second end (such as the source) of the switch Xr is connected to a second end of the inductor L2. A first end (such as the drain) of the switch Xf is connected to the second end of the inductor L2, and a second end (such as the source) of the switch Xf is connected to the first end of the capacitor Cxer2. In addition, the X electrode charge/discharge unit 340 may further include diodes Dx1 and Dx2 for preventing a current path possibly formed by the body diodes of the switches Xr and Xf, respectively. The diode Dx1 is formed on the path of the first end of the capacitor Cxer2, the switch Xr, and the second end of the inductor L2, and the diode Dx2 is formed on the path of the second end of the inductor L2, the switch Xf, and the first end of the capacitor Cxer2.

In addition, the connection sequence of the inductor L1, the switches Yr and Yf, and the diodes Dy1 and Dy2 may be changed, and the connection sequence of the inductor L2, is the switches Xr and Xf, and the diodes Dx1 and Dx2 may be changed. That is, the inductor L1 may be connected between the first end of the capacitor Cyer2 and the common node of the first end of the switch Yr and the second end of the switch Yf, while the inductor L2 may be connected between the first end of the capacitor Cxer2 and the common node of the first end of the switch Xr, and the second end of the switch Xf.

The Y electrode charge/discharge unit 330 charges the Y electrode of the panel capacitor Cp to the sustain-discharge voltage Vs or discharges such voltage to the ground voltage. In addition, the X electrode charge/discharge unit 340 charges the X electrode of the panel capacitor Cp to the sustain-discharge voltage Vs or discharges such voltage to the ground voltage.

Next, the sequential operation of the energy recovery circuit according to the first exemplary embodiment of the present invention will be described with reference to FIGS. 5, 6A to 6H, 7, and 8. Here, the operation proceeds in the order of sixteen (16) modes M1 to M16, which are changed by the manipulation of switches. The phenomenon called "resonance" herein is not a continuous oscillation but a variation of voltage and current caused by the inductor L1 or L2 and the panel capacitor Cp, when the switch Yr, Yf, Xr, or Xf is turned on. In addition, in the driving waveform of switches shown in FIG. 5, the low level represents the turned off state of the switch, and the high level represents the turned on state of the switch.

Figure 5:
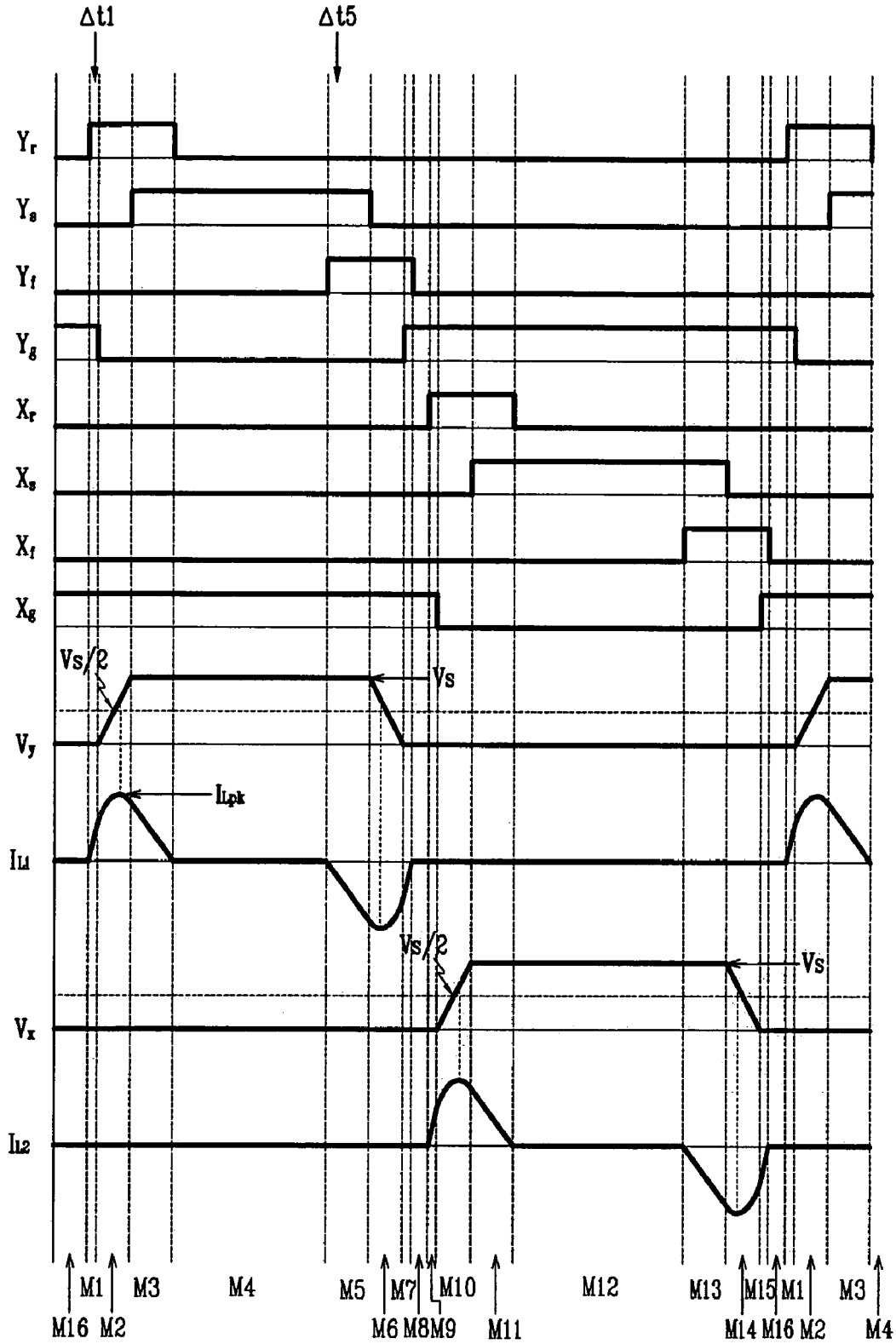
FIG. 5 is a driving timing diagram of the energy recovery circuit according to the first exemplary embodiment of the present invention.
Figure 7:
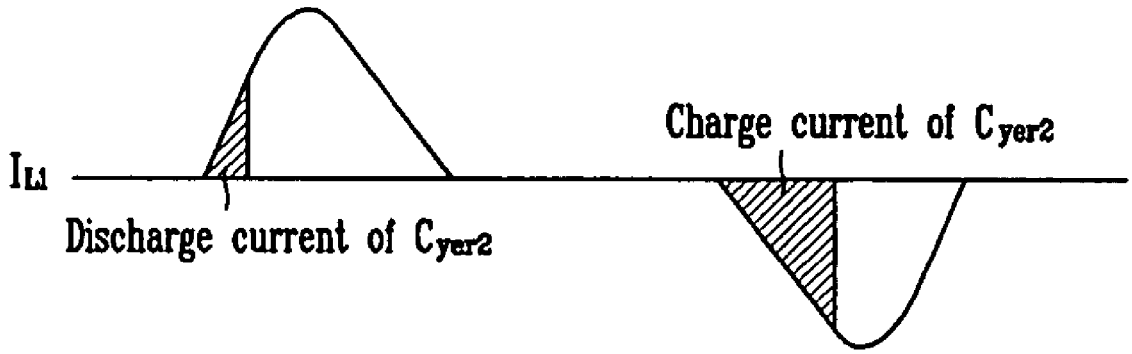
FIG. 7 is a diagram of a discharge current and a charge current of the capacitor in the energy recovery circuit according to the first exemplary embodiment of the present invention.
Figure 8:
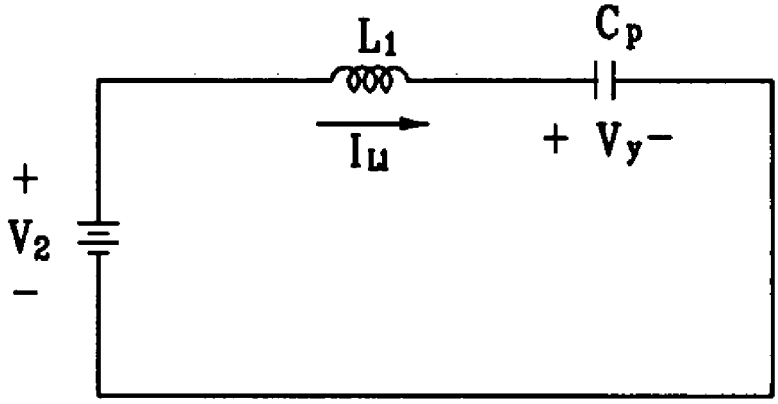
FIG. 8 is an equivalent circuit diagram of the second mode in the energy recovery circuit according to the first exemplary embodiment of the present invention.

FIG. 5 is a driving timing diagram of the energy recovery circuit according to the first exemplary embodiment of the present invention. FIGS. 6A to 6H are circuit diagrams showing the current path of each mode in the energy recovery circuit according to the first exemplary embodiment of the present invention. FIG. 7 is a diagram of a discharge current and a charge current of the capacitor in the energy recovery circuit according to the first exemplary embodiment of the present invention. FIG. 8 is an equivalent circuit diagram of the second mode in the energy recovery circuit according to the first exemplary embodiment of the present invention.

Prior to the operation according to the first exemplary embodiment of the present invention, the switches Yg and Xg are turned on, so Y and X electrode voltages Vy and Vx of the panel capacitor Cp are both maintained at about 0V. The capacitors Cyer1, Cyer2, Cxer1, and Cxer2 are respectively charged with voltages V1, V2, V3, and V4.

Figure 6A:
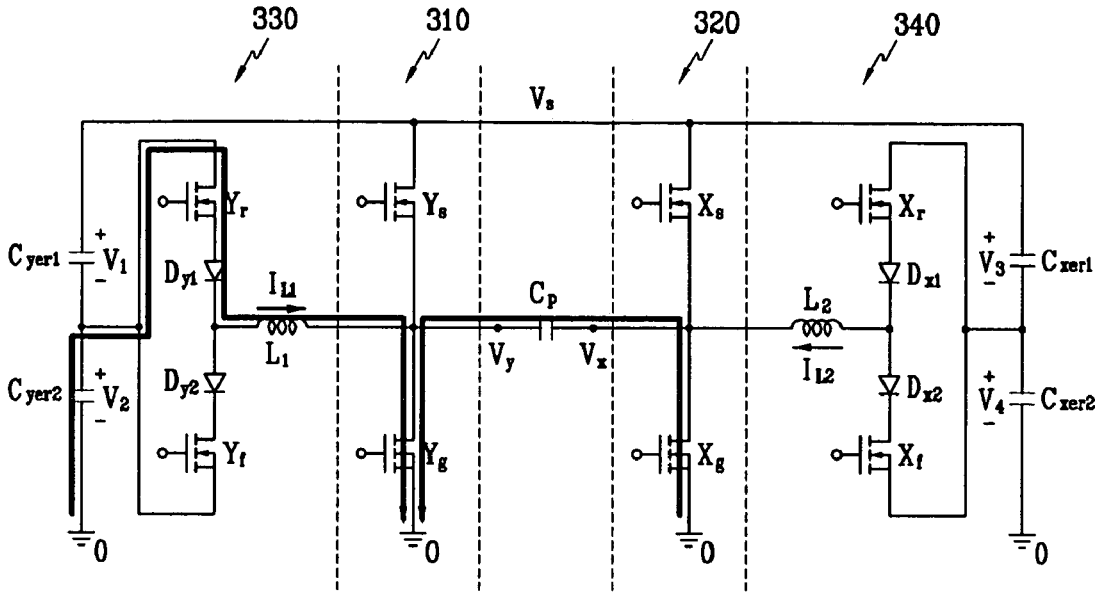
FIGS. 6A to 6H are circuit diagrams showing the current path of each mode in the energy recovery circuit according to the first exemplary embodiment of the present invention.

In the first mode M1, as shown in FIGS. 5 and 6A, the switch Yr is turned on while the switches Yg and Xg are turned on. Then, a current IL1 flowing to the inductor L1 rises with a slope of Vs/2L1 by a current path that includes the capacitor Cyer2, the switch Yr, the inductor L1, and the switch Yg in sequence. That is, the energy is stored (charged) in the inductor L1.

Figure 6B:
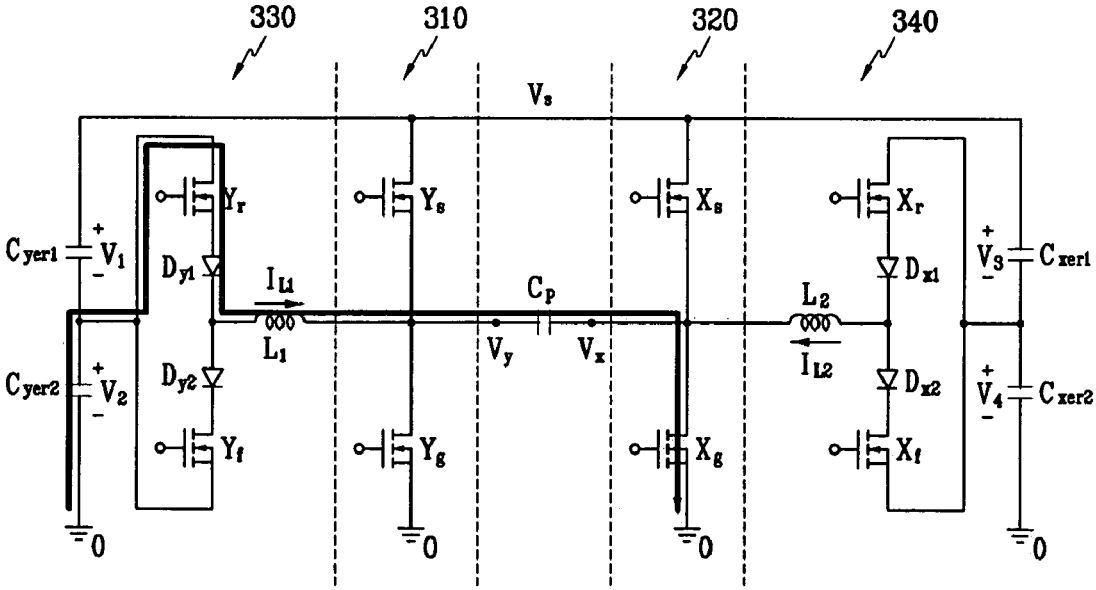

In the second mode M2, as shown in FIG. 5, the switch Yg is turned off while the switches Yr and Xg are turned on. Then, as shown in FIG. 6B, a current path is formed that includes the capacitor Cyer2, the switch Yr, the inductor L1, the panel capacitor Cp, and the switch Xg in sequence, thereby causing an LC resonance. Due to the resonance, the Y electrode voltage Vy of the panel capacitor Cp rises. That is, the panel capacitor Cp is charged.

Because the energy is stored in inductor L1 in the first mode M1, it is possible to raise the Y electrode voltage Vy to a sustain-discharge voltage Vs even when a parasitic component exists in the energy recovery circuit.

In the third mode M3, as shown in FIG. 5, the switch Ys is turned on while the switches Yr and Xg are turned on.

Figure 6C:
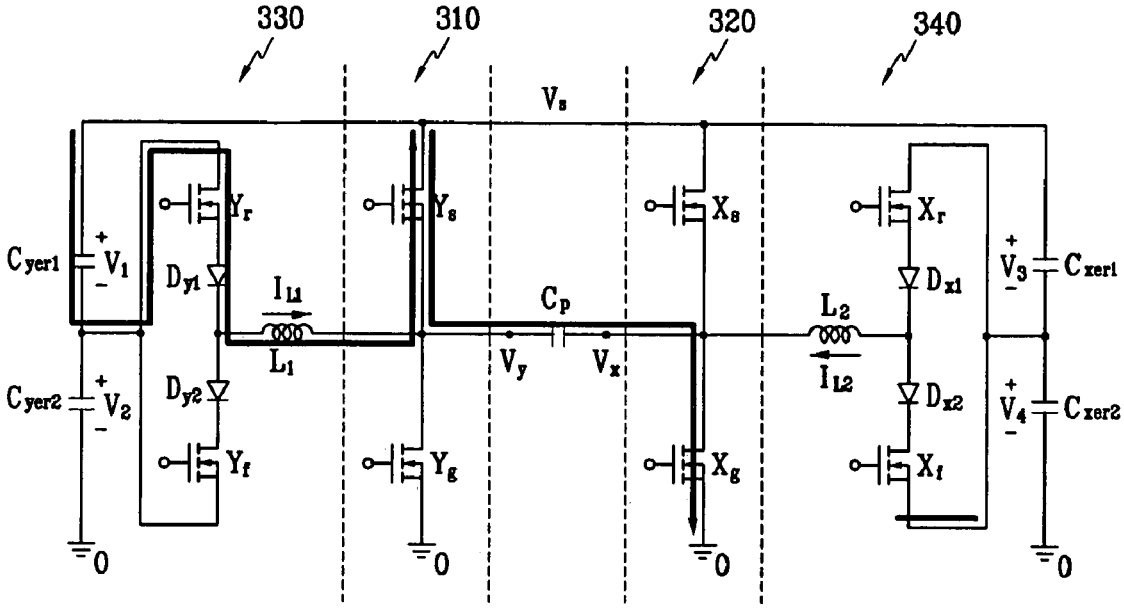

The Y electrode voltage Vy cannot exceed Vs due to the body diode of the switch Ys. The body diode of the switch Ys is automatically turned on when the Y electrode Vy exceeds Vs. In is addition, in the third mode M3, the switch Ys is also turned on. Accordingly, the switch Ys may be turned on at the voltage between their drain and source being zero. In other words, when they perform zero-voltage switching, there is no turn-on switching loss. When the switch Ys is turned on, the Y electrode voltage Vy is maintained at the sustain-discharge voltage Vs as shown in FIG. 6C. Accordingly, both terminal voltage of the panel capacitor Cp (hereinafter referred to as "panel voltage") (Vy-Vx) is maintained at the sustain-discharge voltage Vs so that the discharge occurs.

In addition, the magnitude of the current IL1 flowing to the inductor L1 is reduced to about 0A on the current path that includes the switch Yr, the inductor L1, the body diode of the switch Ys, and the capacitor Cyer1 in sequence, as shown in FIG. 6C. Namely, the energy stored in the inductor L1 is recovered to the capacitor Cyer1. When the voltage of the capacitor Cyer1 is changed by this current, a current is supplied to the capacitor Cyer2.

Figure 6D:
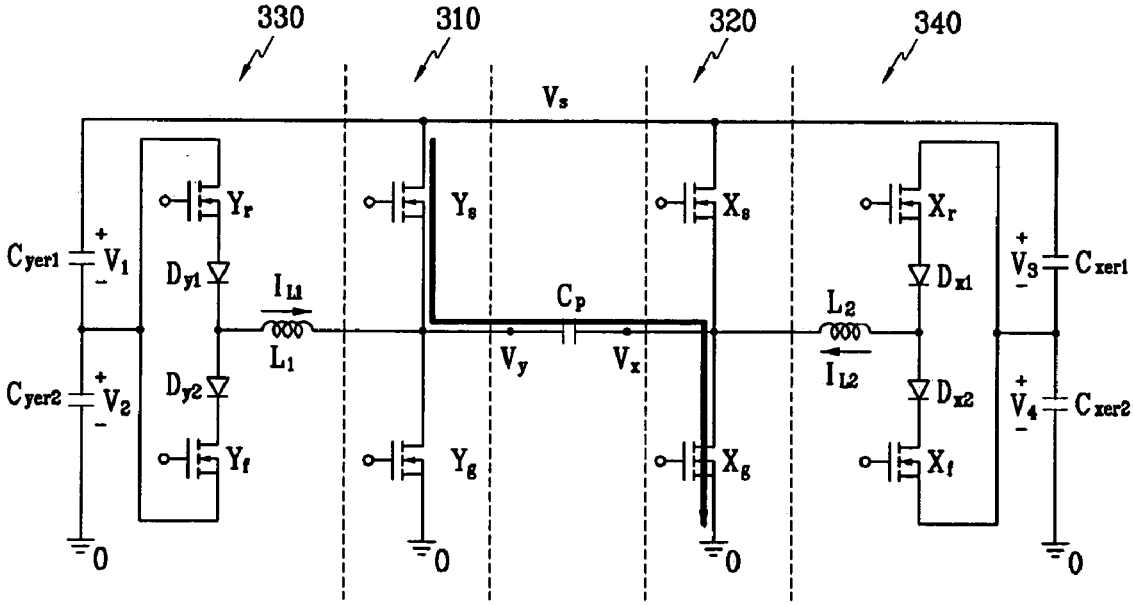

Referring to FIGS. 5 and 6D, in the fourth mode M4, the switch Yr is turned off after the current IL1 flowing to the inductor L1 becomes 0A. Since the switches Ys and Xg are turned on, the Y and X electrode voltages Vy and Vx of the panel capacitor Cp are maintained at Vs and 0V, respectively.

Figure 6E:
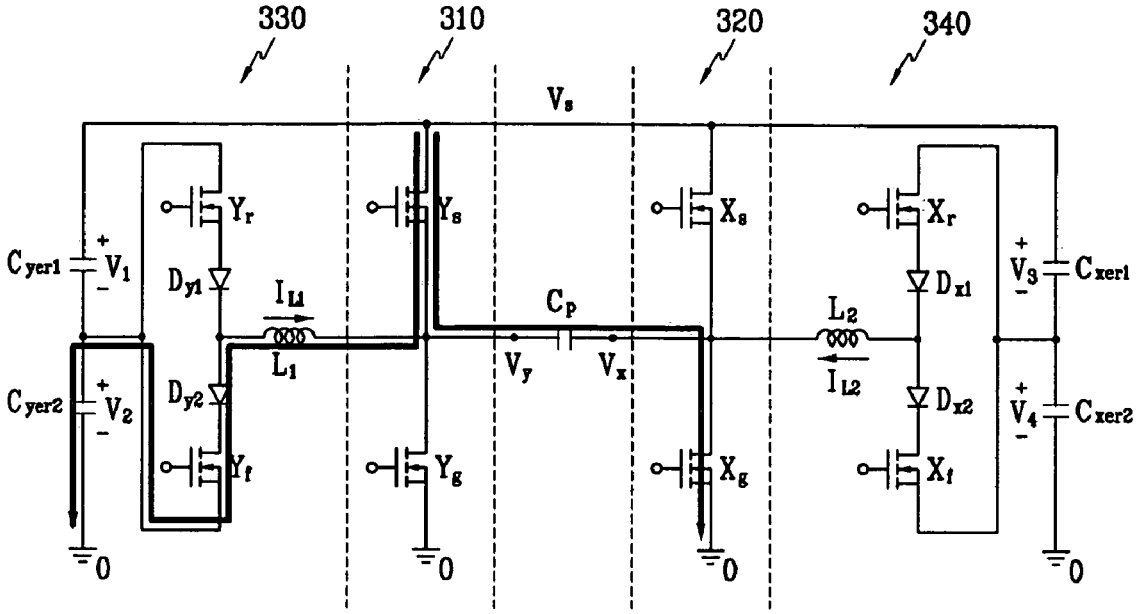

In the fifth mode M5, as shown in FIG. 5, the switch Yf is turned on while the switches Ys and Xg are turned on. Then, a current path is formed that includes the switch Ys, the inductor L1, the switch Yf, and the capacitor Cyer2 in sequence, as shown in FIG. 6E. Therefore, the current IL1 flowing to the inductor L1 is reduced (i.e., the magnitude of the current IL1 rises). That is, the energy is stored in the inductor L1.

Figure 6F:
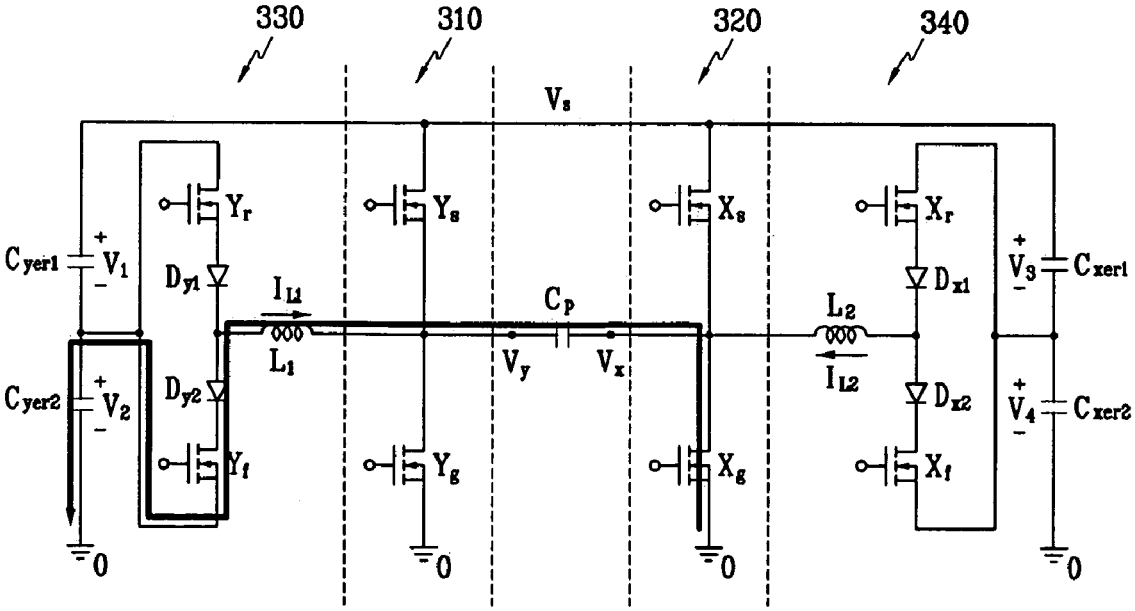

In the sixth mode M6, as shown in FIG. 5, the switch Ys is turned off while the switches Yf and Xg are turned on. Then, as shown in FIG. 6F, a current path is formed that includes the body diode of the switch Xg, the panel capacitor Cp, the inductor L1, the switch Yf, and the capacitor Cyer2 in sequence, thereby causing an LC resonance. Due to the LC resonance, the Y electrode voltage Vy of the panel capacitor Cp is reduced. That is, the panel capacitor is discharged.

In the seventh mode M7, as shown in FIG. 5, the switch Yg is turned on while the switches Yf and Xg are turned on.

The Y electrode voltage Vy cannot exceed 0V due to the body diode of the switch Yg. The body diode of the switch Yg is automatically turned on, when the Y electrode Vy exceeds about 0V. In addition, in the seventh mode M7, the switch Yg is also turned on. Accordingly, the switch Yg may be turned on when the voltage between their drain and source is zero. In other words, when they perform zero-voltage switching, there is no turn-on switching loss. When the switch Yg is turned on, the Y electrode voltage Vy is maintained at about 0V as shown in FIG. 6G.

Figure 6G:
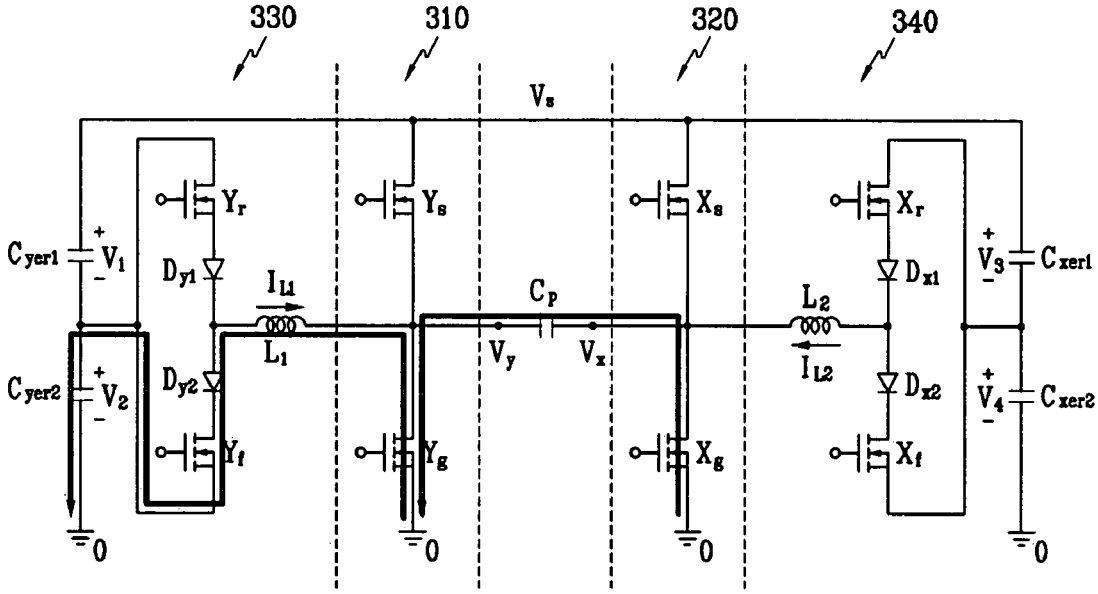

In addition, the current IL1 flowing to the inductor L1 rises (i.e., the magnitude of the current IL1 is reduced) on the current path that includes the body diode of the switch Yg, the inductor L1, the switch Yf, and the capacitor Cyer2 in sequence, as shown in FIG. 6G. Namely, the energy stored in the inductor L1 is recovered to the capacitor Cyer2 through the switch Yf.

Figure 6H:
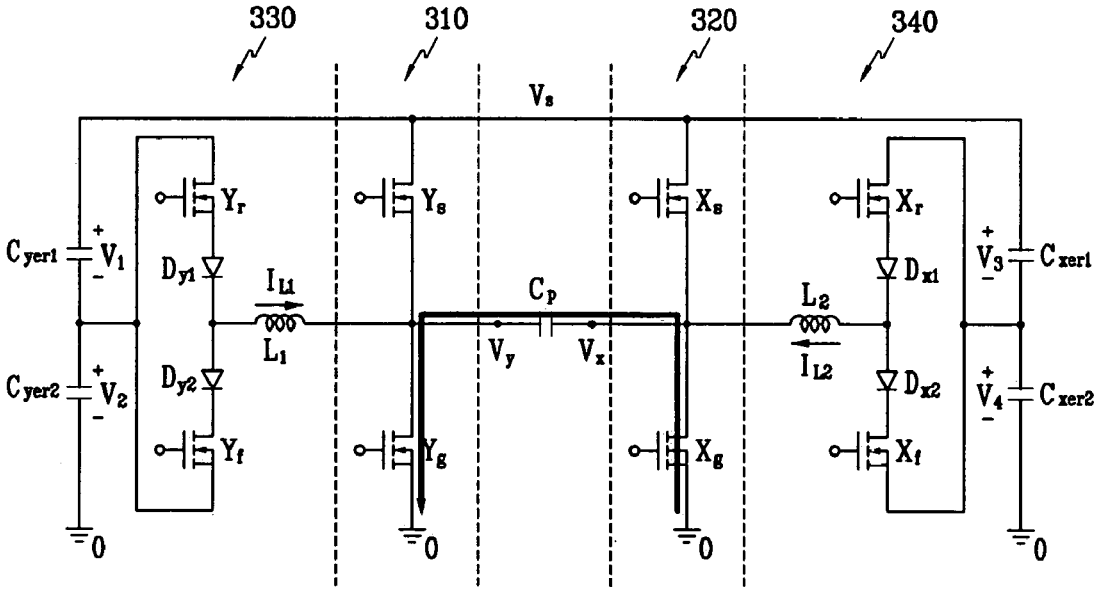

Referring to FIGS. 5 and 6H, in the eighth mode M8, the switch Yf is turned off after the current IL1 flowing to the inductor L1 becomes about 0A. Since the switches Yg and Xg are turned on, the Y and X electrode voltages Vy and Vx of the panel capacitor Cp are both maintained at about 0V.

In the first to eighth modes M1 to M8, the panel voltage (Vy-Vx) swings between about 0V and Vs. As shown in FIG. 5 The switches Xs, Xg, Xr, and Xf and the switches Ys, Yg, Yr, and Yf in the ninth to sixteenth modes M9 to M16 operate in the same manner as the switches Ys, Yg, Yr, and Yf and the switches Xs, Xg, Xr, and Xf in the first to eighth modes M1 to M8, respectively. The X electrode voltage Vx of the panel capacitor Cp in the ninth to sixteenth modes M9 to M16 has the same waveform as the Y electrode voltage Vy in the first to eighth modes M1 to M8. Hence, the panel voltage Vy-Vx in the ninth to sixteenth modes M9 to M16 swings between 0V and −Vs. The operation of the energy recovery circuit according to the first exemplary embodiment of the present invention in the ninth to sixteenth modes M9 to M16 is known to those skilled in the art and will not be described in detail.

As shown in FIGS. 5 and 7, in the first exemplary embodiment, the period Δt1 of the first mode M1 is shorter than the period Δt5 of the fifth mode M5 so that the voltage V2 of the capacitor Cyer2 becomes higher than that the voltage V1 of the capacitor Cyer1. That is, the time where the switches Yr and Yg are both turned on is shorter than the time where the switches Ys and Yf are both turned on. Then, as shown in FIG. 7, the discharge current (i.e., energy) of the capacitor Cyer2 becomes less than the charge current (i.e., energy) of the capacitor Cyer2. By repeating this operation, in the steady state, the voltage V2 of the capacitor Cyer2 is maintained at a voltage which is higher than the voltage V1 of the capacitor Cyer1. That is, the voltage V2 of the capacitor Cyer2 maintains at a voltage which is higher than Vs/2.

The circuit state in the second mode M2 is modeled as shown in FIG. 8 by assuming that the current IL1 flowing to the inductor L1 is $I_{p1}$ at the time when the first mode M1 ends, and the capacitor Cyer2 is a power source supplying V2. In FIG. 8, the current IL1 flowing to the inductor L1 and the Y electrode voltage Vy are given by Equations 1 and 2, respectively.

$$I_{L1}(t) = I_{p1}\cos\omega t + \sqrt{\frac{C_p}{L_1}}\,V_2\sin\omega t = \sqrt{I_{p1}^2 + \frac{C_p}{L_1}V_2^2}\,\sin(\omega t + \theta_1) \quad \text{[Equation 1]}$$

$$V_y(t) = V_2(1-\cos\omega t) + \sqrt{\frac{L_1}{C_p}}\,I_{p1}\sin\omega t = V_2 - \sqrt{V_2^2 + \frac{L_1}{C_p}I_{p1}^2}\,\cos(\omega t + \theta_1) \quad \text{[Equation 2]}$$

In the Equations 1 and 2, $\theta_1$ and $\omega$ are given by Equations 3 and 4, respectively.

$$\theta_1 = \tan^{-1}\frac{\sqrt{\frac{L_1}{C_p}}\,I_{p1}}{V_2} \quad \text{[Equation 3]}$$

$$\omega = \frac{1}{\sqrt{L_1 C_p}} \quad \text{[Equation 4]}$$

Referring to the Equation 1, the magnitude of the current IL1 becomes the maximum at the time tpk where $sin(\omega t+\theta_1)$ is 1, that is, $(\omega t+\theta_1)$ is $\pi/2$. Accordingly, the Y electrode voltage Vy becomes the voltage of V2, which is higher than Vs/2, at the time tpk where the magnitude of the current IL1 is the maximum. Referring to the Equation 2, since the Y electrode voltage Vy exceeds the sustain-discharge voltage Vs, it is possible to increase Y electrode voltage Vy to the sustain-discharge voltage Vs even when a parasitic component exists in the energy recovery circuit. Therefore, the switch Ys performs zero-voltage switching.

In addition, because the Y electrode voltage Vy is higher than Vs/2 when the magnitude of the current IL1 of the inductor L1 reaches the peak point, the Y electrode voltage Vy becomes the sustain-discharge voltage Vs if a little time passes from the time where the magnitude of the current IL1 is maximum. Accordingly, the rising time of the Y electrode voltage (the panel voltage) shortens.

Also, as shown in FIG. 5, much current (energy) remains in the inductor L1 at the latter half of the second mode M2 where the Y electrode voltage Vy rises. When a discharge occurs during the rise of the panel voltage in accordance with discharge cell state, the discharge cannot be sustained if the energy stored in the inductor L1 is not sufficient. However, in the first exemplary embodiment of the present invention, the discharge current can be supplied from the inductor L1, since the energy stored in the inductor L1 is sufficient in the second mode M2. Accordingly, the discharge can be stably sustained until the switch Ys is turned on in the third mode M3 to supply the sustain-discharge voltage Vs.

According to the first exemplary embodiment of the present invention, it is possible to increase the panel voltage to the sustain-discharge voltage Vs since the voltage Vs of the capacitor Cyer2 is higher than Vs/2. Also the energy stored in the inductor can be used in the sustain-discharge. In addition, the Y electrode voltage and the X electrode voltage are changed in an independent manner according to the first exemplary embodiment.

In the first exemplary embodiment of the present invention, two capacitors Cyer1 and Cyer2 are used in the Y electrode charge/discharge unit 330. Differing from this, the capacitor Cyer1 can be removed. In this time, the current can be recovered to the sustain-discharge voltage Vs in the third mode M3. Also, a power source for supplying the voltage V2 can be used other than the capacitor Cyer2.

In the first exemplary embodiment of the present invention, the sustain-discharge voltage Vs is applied to one electrode while the ground voltage 0V is applied to the other electrode. Differing from this, Vs/2 and −Vs/2 can be applied to one electrode and the other electrode, respectively, so that the voltage difference between the X and Y electrodes is the sustain-discharge voltage Vs. This exemplary embodiment will now be described in detail with reference to FIG. 9.

Figure 9:
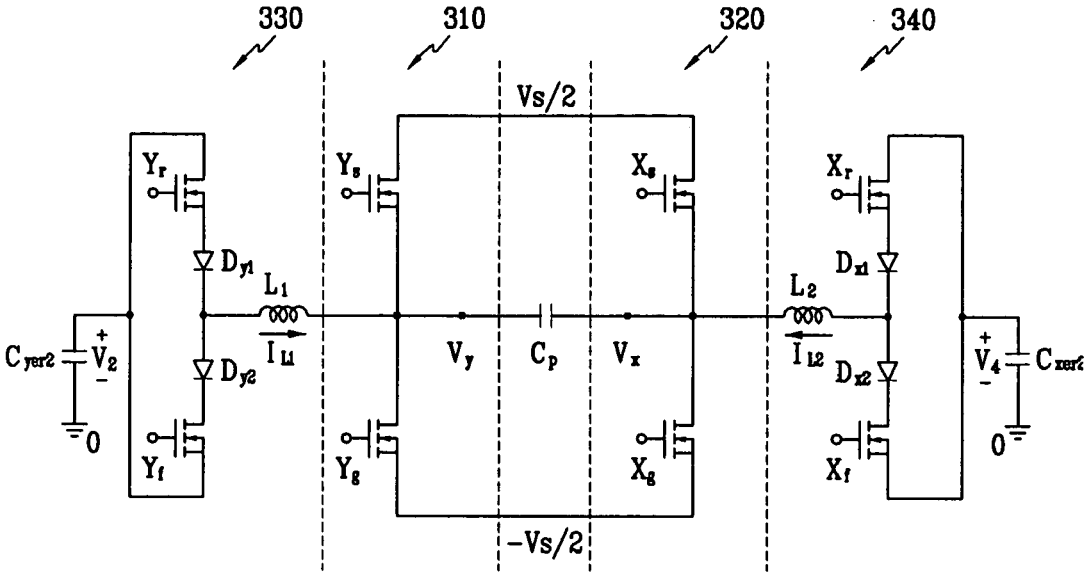
FIG. 9 is a schematic circuit diagram of an energy recovery circuit according to a second exemplary embodiment of the present invention.

FIG. 9 is a schematic circuit diagram of an energy recovery circuit according to a second exemplary embodiment of the present invention.

As shown in FIG. 9, differing from the energy recovery circuit shown in FIG. 4, the first ends of switches Ys and Xs are connected to a voltage source supplying the voltage Vs/2 corresponding to half of the sustain-discharge voltage Vs, and the second ends of switches Yg and Xg are connected to a voltage source supplying the voltage −Vs/2. In addition, the capacitors Cyer1 and Cxer1 of FIG. 4 are eliminated. Since a detailed structure of the energy recovery circuit shown in FIG. 5 may be easily understood from the description of the circuit shown in FIG. 4, no further description will be provided.

In the circuit shown in FIG. 9, the driving timing of the switches Ys, Yg, Yr, Yf, Xs, Xg, Xr, and Xf is the same as those shown in FIG. 5. In addition, the time of the first mode M1 is shorter than the time of the fifth mode M5, so that the discharge energy of the capacitor Cyer2 is less than the charge energy of the capacitor Cyer2. As a result, the voltages V2 and V4 of the capacitors Cyer2 and Cxer2 are higher than about 0V corresponding to the mean value of the voltages Vs/2 and Vs/2 and are lower than the voltage Vs/2.

Then, the panel voltage (Vy-Vx) swings between 0V and Vs through the first to eighth modes M1 to M8, and the panel voltage (Vy-Vx) swings between 0V and −Vs through the ninth to sixteenth modes M9 to M16. That is, the voltages Vs/2 and −Vs/2 are applied to the Y electrode and the X electrode in turn so that the sustain-discharge occurs. Since a detailed operation of the energy recovery circuit according to the second exemplary embodiment may be easily understood from the description of the first exemplary embodiment, no further description will be provided.

Also, in the second exemplary embodiment, the voltages Vs/2 and −Vs/2 are applied to the Y electrode and the X electrode in turn. Differing from this, two voltages Vh and (Vh-Vs) having a voltage difference of Vs may be applied to the Y electrode and the X electrode in turn. In this case, the capacitor Cyer2 may be charged to a voltage more than (2Vh-Vs)/2.

Although the same inductor L1 is used for raising and reducing the Y electrode voltage Vy in the first and second exemplary embodiments of the present invention, independent inductors may also be used for increasing and decreasing the Y electrode voltage Vy. This exemplary embodiment will be described below in detail with reference to FIG. 10.

Figure 10:
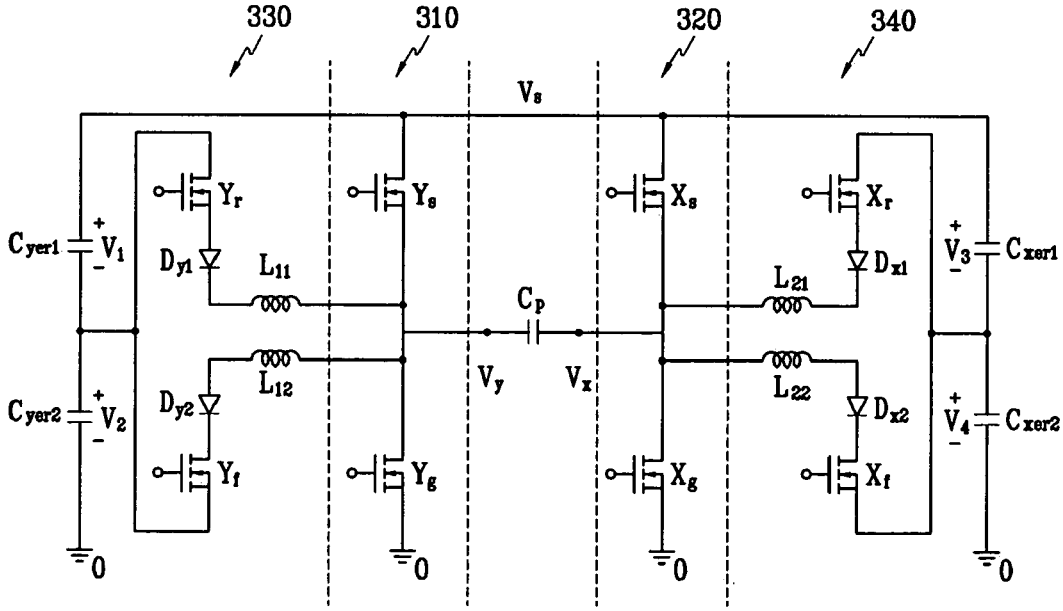
FIG. 10 is a schematic circuit diagram of an energy recovery circuit according to a third exemplary embodiment of the present invention.

FIG. 10 is a schematic circuit diagram of an energy recovery circuit according to a third exemplary embodiment of the present invention.

As shown in FIG. 10, differing from the first exemplary embodiment, in the energy recovery circuit according to the third exemplary embodiment, two inductors L11 and L12 are connected to the Y electrode of the panel capacitor Cp rather than the inductor L1, and two inductors L21 and L22 are connected to the X electrode of the panel capacitor Cp rather than the inductor L2. That is, the inductor L11 is connected between the Y electrode and the switch Yr, and the inductor L12 is connected between the Y electrode and the switch Yf. The connection sequence of the inductor L11 and the switch Yr may be changed, and the connection sequence of the inductor L12 and the switch Yf may be changed. Likewise, the inductor L21 is connected between the X electrode and the switch Xr, and the inductor L22 is connected between the X electrode and the switch Xf. The connection sequence of the inductor L21 and the switch Xr may be changed, and the connection sequence of the inductor L22 and the switch Xf may be changed.

Then, the current flows in the inductor L11 in the first to third modes M1 to M3, and the current flows in the inductor L12 in the fifth to seventh modes M5 to M7. Likewise, the current flows in the inductor L21 in the ninth to eleventh modes M9 to M11, and the current flows in the inductor L12 in the thirteenth to fifteenth modes M13 to M15.

According to the third exemplary embodiment of the present invention, the power consumption is reduced since a current of one direction flows in one inductor. Although the Y electrode voltage Vy and the X electrode voltages Vx are changed independently in the first to third exemplary embodiments of the present invention, both voltages Vy and Vx can be simultaneously changed. This exemplary embodiment will be described below in detail with reference to FIG. 11.

Figure 11:
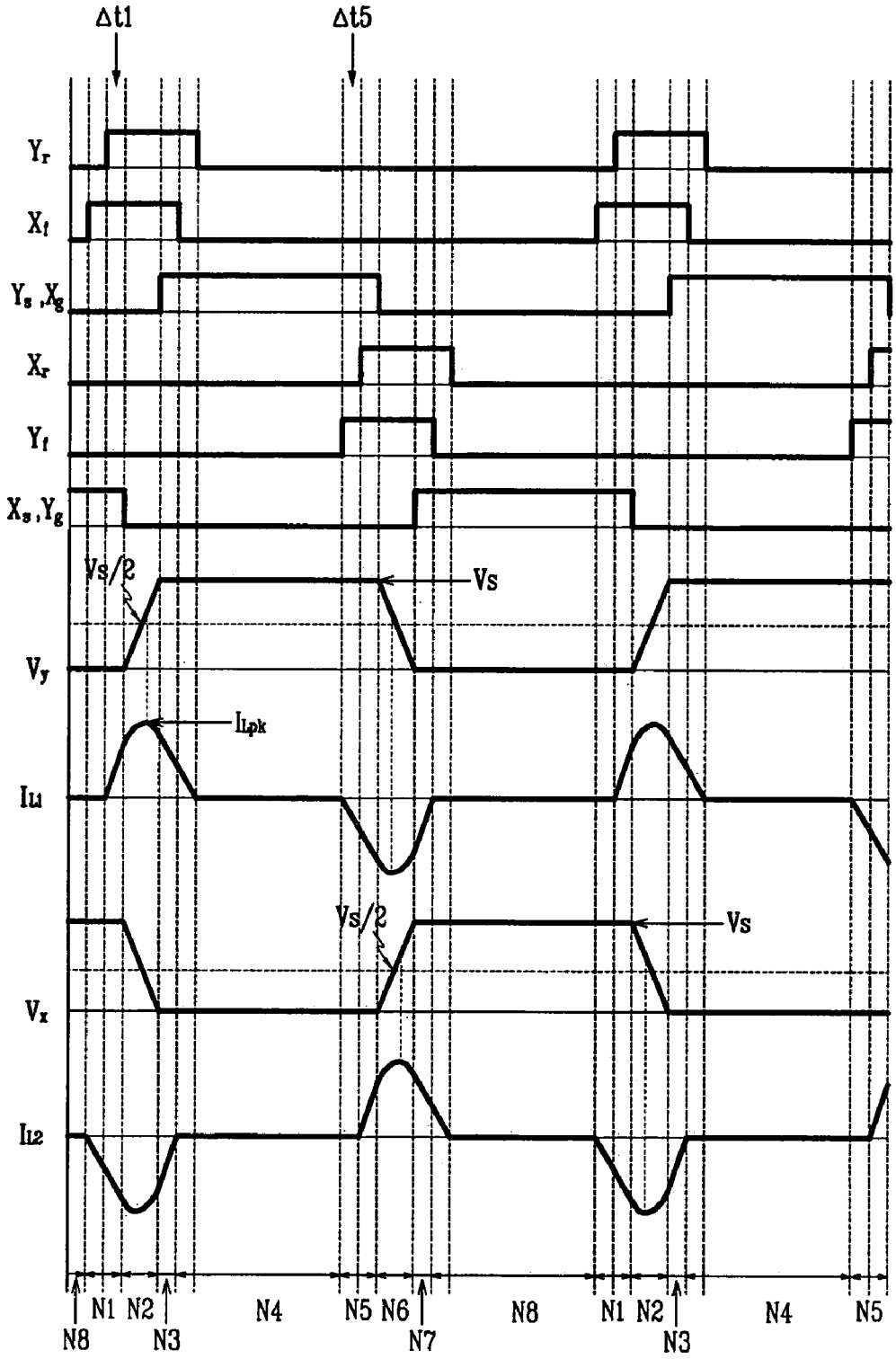
FIG. 11 is a driving timing diagram of an energy recovery circuit according to a fourth exemplary embodiment of the present invention.

FIG. 11 is a driving timing diagram of an energy recovery circuit according to a fourth exemplary embodiment of the present invention.

As shown in FIG. 11, the driving timing of the energy recovery circuit according to the fourth exemplary embodiment is different from that of the energy recovery circuit according to the fifth exemplary embodiment. In detail, the first and thirteenth modes M1 and M13, the second and fourteenth modes M2 and M14, the third and fifteenth modes M3 and M15, the fifth and ninth modes M5 and M9, the sixth and tenth modes M6 and M10, and the seventh and eleventh modes M7 and M11 of FIG. 5 are overlapped, respectively. These correspond to the first, second, third, fifth, sixth and seventh modes N1, N2, N3, N5, N6, and N7 of FIG. 11, respectively. Also, the eighth and sixteenth modes M8 and M16 of FIG. 5 are eliminated, and the fourth and twelfth modes M4 and M12 of FIG. 5 correspond to the fourth and eighth modes N4 and N8 of FIG. 11. Next, the sequential operation of the energy recovery circuit according to the fourth exemplary embodiment of the present invention will be described with reference to FIGS. 5 and 11.

Referring to N1 of FIG. 11, in the first mode N1, the switch Xf is firstly turned on while the switches Yg and Xs are turned on. Then a current path is formed that includes the switch Xs, the inductor L2, the switch Xf, and the capacitor Cxer2 in sequence. After the switch Xf is turned on, the switch Yr is turned on so that a current path is formed that includes the capacitor Cyer2, the switch Yr, the inductor L1 and the switch Yg in sequence. As shown in FIG. 11, the magnitudes of currents IL1 and IL2 flowing to the inductors L1 and L2 rise with a slope of V2/L1 and a slope of (Vs-V4)/L2, respectively. That is, the energy is stored (charged) in the inductors L1 and L2.

Referring to N2 of FIG. 11, in the second mode N2, the switches Yg and Xs are turned off while the switches Yr and Xf are turned on. Then, a current path is formed that includes the capacitor Cyer2, the switch Yr, the inductor L1, the panel capacitor Cp, the inductor L2, the switch Xf, and the capacitor Cxer2 in sequence, thereby causing an LC resonance. Due to the resonance, the Y electrode voltage Vy of the panel capacitor Cp rises, and the X electrode voltage Vx is reduced. As described above, because the voltage V2 of the capacitor Cyer2 is higher than the voltage Vs/2, the Y electrode voltage Vy is higher than the voltage Vs/2 at the time where the magnitude of the current IL1 is maximum.

Referring to N3 of FIG. 11, in the third mode N3, the switches Ys and Xg are turned on while the switches Yr and Xf are turned on so that the Y and X electrode voltages Vy and Vx are maintained at the sustain-discharge voltage Vs and the ground voltage of about 0V, respectively. In addition, the current IL1 flowing to the inductor L1 is recovered to the path that includes the switch Yr, the inductor L1, the body diode of the switch Ys, and the capacitor Cyer1 in sequence. The current IL2 flowing to the inductor L2 is recovered to the path that includes the body diode of the switch Xg, the inductor L2, the switch Xf, and the capacitor Cxer2 in sequence.

Referring to N4 of FIG. 11, in the fourth mode N4, the switch Xf is firstly turned off after the current LL2 flowing to the inductor L2 becomes 0A. After the switch Xf is turned off, the switch Yr is turned off when the current LL1 flowing to the inductor L1 becomes about 0A.

Referring to N5 of FIG. 11, in the fifth mode N5, the switch Yf is firstly turned on while the switches Ys and Xg are turned on. Then, a current path is formed that includes the switch Ys, the inductor L1, the switch Yf, and the capacitor Cyer2 in sequence. After the switch Yf is turned on, the switch Xr is turned on so that a current path is formed that includes the capacitor Cxer2, the switch Xr, the inductor L2, and the switch Xg in sequence. Then, the energy is stored (charged) in the inductors L1 and L2.

Referring to N6 of FIG. 11, in the sixth mode N6, the switches Ys and Xg are turned off while the switches Yf and Xr are turned on. Then, a current path is formed that includes the capacitor Cxer2, the switch Xr, the inductor L2, the panel capacitor Cp, the inductor L1, the switch Yf, and the capacitor Cyer2 in sequence, thereby causing an LC resonance. Due to the resonance, the Y electrode voltage Vy of the panel capacitor Cp is decreased and the X electrode voltage Vx is increased. In addition, because the voltage V4 of the capacitor Cxer2 is higher than the voltage Vs/2, the X electrode voltage Vx is higher than the voltage Vs/2 at the time where the magnitude of the current IL2 is maximum.

Referring to N7 of FIG. 11, in the seventh mode N7, the switches Yg and Xs are turned on, while the switches Yf and Xr are turned on so that the Y and X electrode voltages Vy and Vx are maintained at the ground voltage about 0V and the sustain-discharge voltage Vs, respectively. In addition, the current IL1 flowing to the inductor L1 is recovered to the path that includes the body diode of the switch Yg, the inductor L1, the switch Yf, and the capacitor Cyer2 in sequence. The current IL2 flowing to the inductor L2 is recovered to the path that includes the switch Xr, the inductor L2, the body diode of the switch Xs, and the capacitor Cxer1 in sequence.

Referring to N8 of FIG. 11, in the eighth mode N8, the switch Yf is firstly turned off after the current LL1 flowing to the inductor L1 becomes about 0A. After the switch Yf is turned off, the switch Xr is turned off when the current LL2 flowing to the inductor L2 becomes about 0A.

Through the first to eighth modes M1 to M8 in the fourth exemplary embodiment, the panel voltage (Vy-Vx) swings between −Vs and Vs. In addition, the time where the switches Yr and Yg are both turned on in the first mode N1 is shorter than the time where the switches Ys and Yf are both turned on in the fifth mode N5, so that the discharge energy of the capacitor Cyer2 is less than the charge energy of the capacitor Cyer2. Then, the voltage V2 of the capacitor Cyer2 is higher than Vs/2. Likewise, the time where the switches Xf and Xs are both turned on in the first mode N1 is longer than the time where the switches Xr and Xg are both turned on in the fifth mode N5, so that the charge energy of the capacitor Cxer2 is greater than the discharge energy of the capacitor Cxer2. Then, the voltage V2 of the capacitor Cxer2 is higher than Vs/2.

The energy recovery circuit connected to the Y electrode of the panel is described in the exemplary embodiments of the present invention. However, as mentioned above, this energy recovery circuit can be applied to the X electrode. Also, when the applied voltage is changed, this circuit can be applied to the address electrode.

In the first to fourth exemplary embodiments, since the voltages V2 and V4 charged to the energy recovery capacitors Cyer1 and Cyer2 is higher than Vs/2, and the resonance occurs while the current is flowing to the inductors L1 and L2, the big current flows when the Y electrode voltage Vy and the X electrode voltage Vx rise. Generally, because the power consumption of the plasma display panel increases when the number of the discharge cells to be discharged increases, the automatic power controlling method is used in the plasma display device in order to restrict the power consumption. By the automatic power controlling method, the number of the sustain pulses may be controlled according to the number of the discharge cells to be discharged (a load ratio) on the plasma display panel. That is, the number of the sustain pulses is reduced when the load ratio increases so that the power consumption is restricted.

However, in the first to fourth exemplary embodiments of the present invention, because the number of the sustain pulses is many and flowing of the big current is repeated by the number of the sustain pulses when the load ratio is low, greater thermal stress may be applied to the energy recovery circuit. An exemplary embodiment which may reduce the thermal stress will be described with reference to FIGS. 12, 13A and 13B, and the plasma display device and the energy recovery circuit shown in FIGS. 3 to 6H.

Figure 12:
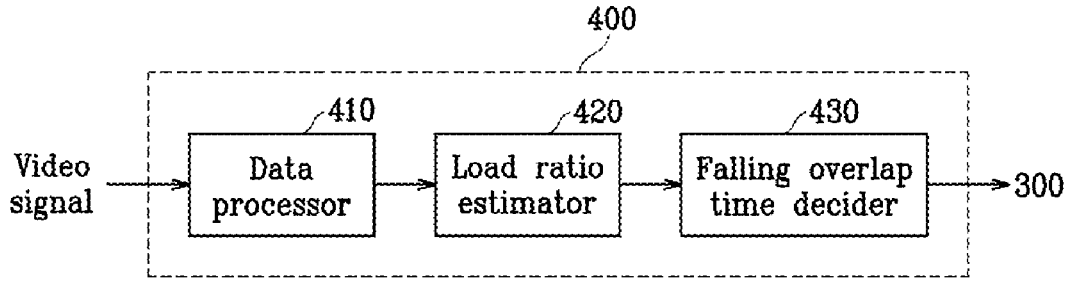
FIG. 12 shows a controller of a plasma display device according to a fifth exemplary embodiment of the present invention.
Figure 13A:
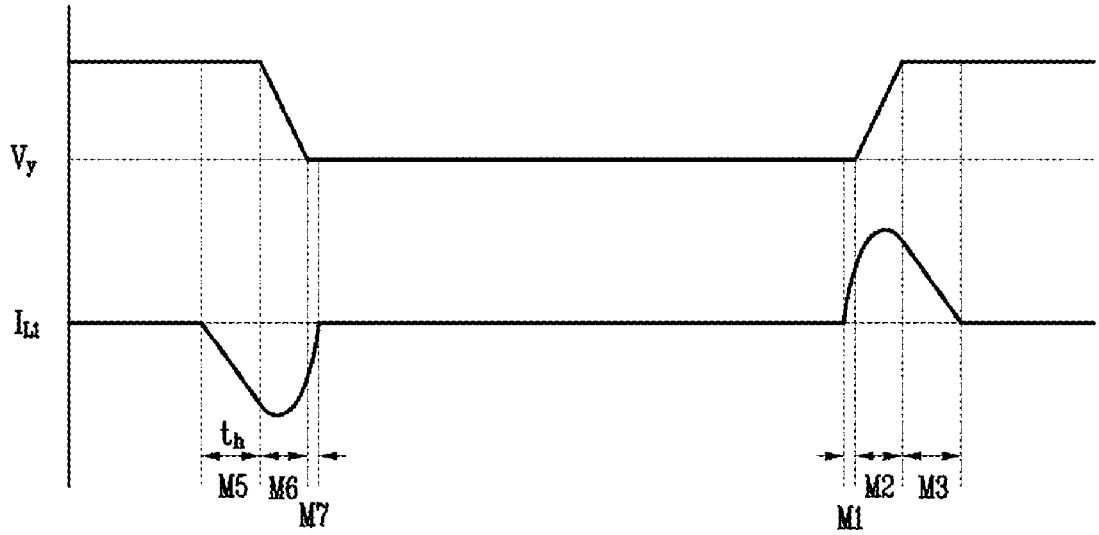
FIG. 13A shows the Y electrode voltage and the inductor current when the load ratio is high.
Figure 13B:
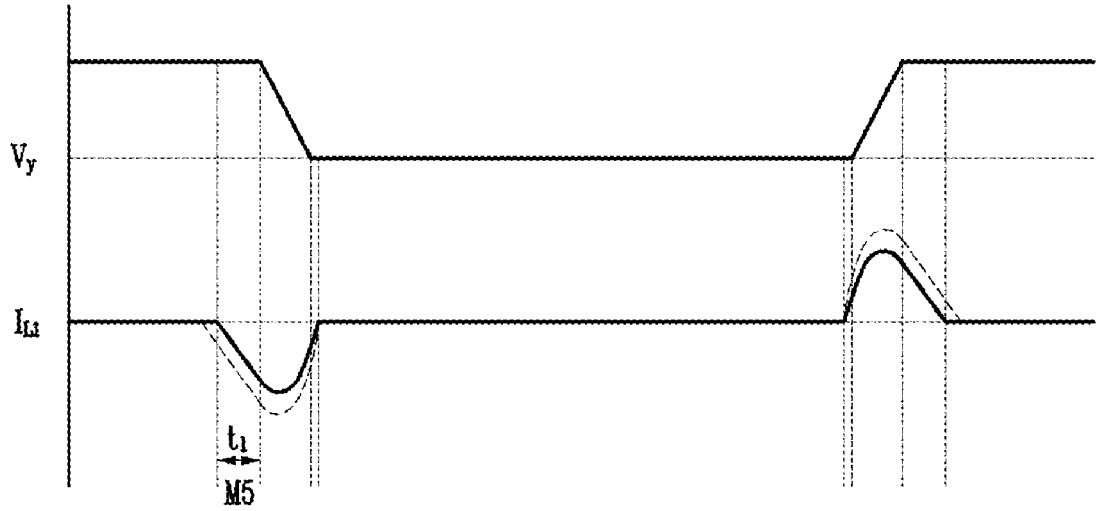
FIG. 13B shows the Y electrode voltage and the inductor current when the load ratio is low.

FIG. 12 shows a controller 400 of a plasma display device according to a fifth exemplary embodiment of the present invention. FIG. 13A shows the Y electrode voltage and the inductor current when the load ratio is high, and FIG. 13B shows the Y electrode voltage and the inductor current when the load ratio is low.

As shown in FIG. 12, the controller 400 of the plasma display device according to the fifth exemplary embodiment of the present invention includes a data processor 410, a load ratio estimator 420, and a falling overlap time decider 430.

The data processor 410 converts the external video signals to the on/off data in the each subfield. Assuming that one frame (i.e., one TV field) is divided into eight subfields 1SF to 8SF which have the weights of 1, 2, 4, 8, 16, 32, 64, and 128 as the lengths of the sustain periods, respectively, the data processor 410 converts (for example) the video signal of 100 gray levels to 8 bit data of "00100110". The digits "0" and "1" in the "00100110" respectively correspond to on/off states of the eight subfields 1SF to 8SF in the discharge cell (dot). That is, "0" represents that the discharge cell will be not discharged (off) in the correspond subfield, and "1" represents that the discharge cell (dot) will be discharged (on) in the correspond subfield.

The load ratio estimator 420 estimates the number of the discharge cells which will be turned on in each subfield from the video signals converted to on/off data in the data processor 410. The falling overlap time decider 430 decides the time of the fifth mode M5 according to the number of the discharge cells to be turned on in each subfield. The fifth mode M5 is the time where the switches Yr and Yg are both turned on so as to supply the current to the inductor L1 before the Y electrode voltage Vy is reduced. Hereinafter, the time of the mode M5 is referred to as a "falling overlap time". The falling overlap time decider 430 sets the falling overlap time to be long when a lot of discharge cells will be turned on i.e., the load ratio is high. The falling overlap time decider 430 sets the falling overlap time to be short when few discharge cells will be turned on i.e., the load ratio is low. In addition, the falling overlap time decider 430 decides the falling overlap time in respective subfields. Furthermore, the falling overlap times according to the load ratio may be stored to the memory (not shown) as shape of a lookup table, or may be calculated.

Referring to FIGS. 13A and 13B, the falling overlap time tl at the time when the load ratio is low is shorter than the falling overlap time th at the time when the load ratio is high. For example, a falling overlap time may be set to the time where the sustain-discharge becomes stable, and the falling overlap time tl may be shorter than the falling overlap time th by more than one clock which is an inner clock of the controller 400.

As expressed in Equation 1, the current flowing to the inductor L1 at the time when the Y electrode voltage Vy rises is determined by the voltage V2 of the capacitor Cyer2 and the inductor current $I_{pl}$ at the time when the resonance begins. However, because the energy charged to the capacitor Cyer2 in the fifth and sixth modes M5 and M6 becomes less when the falling overlap time becomes shorter, the voltage V2 of the capacitor Cyer2 becomes lower. Because the current supplied to the inductor L1 in the following the first mode M1 is in proportion to the voltage V2 of the capacitor Cyer2, the inductor current $I_{pl}$ at the time when the resonance begins becomes less. As a result, since the inductor current $I_{pl}$ becomes less, and the voltage V2 of the capacitor Cyer2 becomes lower, the current flowing to the inductor L1 by the resonance becomes less in the second mode M2.

That is, as shown in FIG. 13B, when the falling overlap time $t_L$ is short, the current IL1 flowing to the inductor L1 is lower than that of the FIG. 13A. Therefore, when the load ratio becomes lower and the number of the sustain pulses increases, the current at the time where the sustain-discharge occurs reduces so that the thermal stress applied to the energy recovery circuit is reduced.

In the fifth exemplary embodiment of the present invention, the load ratio is compared to one predetermined value, but the load ratio may be compared to many predetermined values. For example, when comparing to two predetermined values, the falling overlap times of the case in which the load ratio is higher than the first predetermined value, the case in which the load ratio is between the first predetermined value and the second predetermined value, and the case in which the load ratio is lower that the second predetermined value may be different.

In the fifth exemplary embodiment of the present invention, the load ratio is estimated from the number of the discharge cells to be turned on in each subfield, and the falling overlap time is decided. Differing from this, the load ratio may be estimated from the video signals corresponding to one frame, and the falling overlap time may be decided at each frame. That is, the load ratio is estimated from the gray levels of the video signals corresponding to one frame. As expressed in Equation 5, the data processor 410 calculates the average signal level ASL of the external video signals during one frame. The load ratio estimator 420 may determine that the load ratio is high when the average signal level ASL is high and the load ratio is low when the average signal level ASL is low. The falling overlap time decider 430 may determine the falling overlap time of the corresponding frame in accordance with the load ratio.

$$ASL = \left(\sum_V R_n + \sum_V G_n + \sum_V B_n\right) \Big/ 3N \qquad \text{[Equation 5]}$$

where Rn, Gn, and Bn are the signal levels of the R, G, and B video signals, V is the one frame, and 3N is the number of the R, G, and B video signals inputted during one frame.

As described above, according to the present invention, the panel capacitor is charged to the sustain-discharge voltage despite the parasitic components of the actual circuit, and hence the zero-voltage switching is performed and the stable sustain-discharge is performed. In addition, when the load ratio is low, the current at the time where the sustain-discharge is performed may be less so that the thermal stress of the energy recovery circuit may be reduced.

While this invention has been described in connection with what is presently considered to be the most practical and preferred embodiment, it is to be understood that the invention is not limited to the disclosed embodiments, but is intended to cover various modifications and equivalent arrangements included within the spirit and scope of the appended claims.

What is claimed is:

1. A plasma display device, which includes a plurality of first electrodes and a plurality of second electrodes, and a panel capacitor being formed by a first electrode and a second electrode, the plasma display device comprising:

a first driver including a first inductor having a first end coupled to the first electrode and a second inductor having a first end coupled to the first electrode, and to apply a first voltage and a second voltage to the first electrode in turn; and a controller to calculate a load ratio from video signals and to control an operation of the first driver, wherein the first driver applies the first voltage to the first electrode after raising the voltage of the first electrode through the first inductor, supplies energy to the second inductor during a first time period while maintaining the first electrode at the first voltage, and applies the second voltage to the first electrode after reducing the voltage of the first electrode through the second inductor, and the first time period has a first duration if the load ratio is less than a predetermined value and a second duration if the load ratio is greater than the predetermined value, the first duration being shorter than the second duration.

2. The plasma display device of claim 1, wherein the load ratio is determined by the number of the discharge cells to be turned on in at least one subfield.

3. The plasma display device of claim 1, wherein the load ratio is determined by the signal level of the video signal inputted in at least one frame.

4. The plasma display device of claim 1, wherein the difference between the first voltage and the second voltage is a sustain-discharge voltage.

5. The plasma display device of claim 4, further comprising a second driver applying the first voltage and the second voltage to the second electrode in turn, wherein the second driver applies the second voltage to the second electrode while the first driver applies the first voltage to the first electrode, and the second driver applies the first voltage to the second electrode while the first driver applies the second voltage to the first electrode.

6. The plasma display device of claim 5, wherein the second voltage is the ground voltage.

7. The plasma display device of claim 5, wherein the mean value of the first voltage and the second voltage is the ground voltage.

8. The plasma display device of claim 1, wherein the first driver further includes a capacitor coupled to a second end of the first inductor and a second end of the second inductor through at least one switch, a discharge energy of the capacitor includes energy for raising the voltage of the first electrode, and a charge energy of the capacitor includes energy supplied through the second inductor during the first time period, and energy supplied while the voltage of the first electrode is reduced.

9. The plasma display device of claim 8, wherein the charge energy of the capacitor is greater than the discharge energy of the capacitor.

10. The plasma display device of claim 9, wherein the first driver supplies energy to the first inductor during a second time period while maintaining the first electrode at the second voltage, and the second time period is shorter than the first time period.

11. The plasma display device of claim 1, wherein the voltage of the first electrode rises from the second voltage to a third voltage while the magnitude of a current flowing to the first inductor rises, and the third voltage is between a fourth voltage corresponding to the mean value of the first voltage and second voltage and the first voltage.

12. The plasma display device of claim 1, wherein the first inductor is the second inductor.

13. The plasma display device of claim 1, wherein the first inductor has a different inductance than the second inductor.

14. A plasma display device, comprising:

a panel including a plurality of first electrodes and a plurality of second electrodes, and a panel capacitor being formed by a first electrode and a second electrode;

a first driver to apply a first voltage and a second voltage to the first electrode in turn; and a controller to calculate a load ratio from video signals and to control an operation of the first driver, wherein the first driver includes:

at least one inductor having a first end coupled to the first electrode, a first switch coupled between the first electrode and a first voltage source that supplies the first voltage, a second switch coupled between the first electrode and a second voltage source that supplies the second voltage, a capacitor, and at least one third switch coupled between a second end of the inductor and a first end of the capacitor, or between the first end of the inductor and the first electrode, and wherein a time period when the first switch and the third switch are both turned on has a first duration if the load ratio is less than a predetermined value and a second duration if the load ratio is greater than the predetermined value, the first duration being shorter than the second duration.

15. The plasma display device of claim 14, wherein the first voltage is applied to the first electrode by a turn-on of the first switch after the voltage of the first electrode rises by a turn-on of the third switch, a current is supplied to the inductor by turn-on of both the first switch and the third switch, and the second voltage is applied to the first electrode by a turn-on of the second switch after the voltage of the first electrode is reduced by a turn-on of the third switch.

16. The plasma display device of claim 15, wherein the second voltage is applied to the second electrode while the first voltage is applied to the first electrode, and the difference between the first voltage and the second voltage is a sustain-discharge voltage.

17. The plasma display device of claim 16, wherein a current is supplied to the inductor by turn-on of both the second switch and the third switch before raising the voltage of the first electrode, and the time period when the first switch and the third switch are both turned on is longer than a time period when the second switch and the third switch are both turned on.

18. The plasma display device of claim 14, wherein the at least one inductor includes a first inductor and a second inductor, and a current flowing from the second end to the first end of the at least one inductor passes through the first inductor, and a current flowing from the first end to the second end of the at least one inductor passes through the second inductor.

19. The plasma display device of claim 14, wherein the load ratio is determined by the number of the discharge cells to be turned on in at least one subfield.

20. A driving method of a plasma display panel, which includes a plurality of first electrodes and a plurality of second electrodes, and a panel capacitor being formed by a first electrode and a second electrode, the driving method comprising:

charging the panel capacitor through a first inductor coupled to the first electrode;

applying a first voltage to the first electrode;

supplying a current to a second inductor coupled to the first electrode during a first time period while maintaining the first electrode at the first voltage;

discharging the panel capacitor through the second inductor; and applying a second voltage to the first electrode, wherein the first time period has a first duration if a number of discharge cells to be turned on is less than a predetermined value and a second duration if the number of discharge cells to be turned on is greater than the predetermined value, the first duration being shorter than the second duration.

21. The driving method of claim 20, wherein the second voltage is applied to the second electrode while the first voltage is applied to the first electrode, and the difference between the first voltage and the second voltage is a sustain-discharge voltage.

22. The driving method of claim 21, further comprising:

supplying a current to the first inductor during a second time period before charging the panel capacitor, wherein a direction of the current supplied to the first inductor is the same as a direction of the current flowing to the first inductor when charging the panel capacitor, and a direction of the current supplied to the second inductor is the same as a direction of the current flowing to the second inductor when discharging the panel capacitor.

23. The driving method of claim 22, wherein the first time period is longer than the second time period.

24. The driving method of claim 20, wherein a current having the same direction as the current flowing to the first inductor when charging the panel capacitor is a current discharged from a capacitor, and a current having the same direction as the current flowing to the second inductor when discharging the panel capacitor is a current charged to the capacitor.

25. The driving method of claim 20, wherein the first inductor is the second inductor.

26. A plasma display device, which includes a plurality of first electrodes and a plurality of second electrodes, and a panel capacitor being formed by the first electrode and the second electrode, the plasma display device comprising:

a means for applying a first voltage and a second voltage to the first electrode in turn; and a means for calculating a load ratio from video signals and controlling an operation of the first driver, wherein the means for applying a first voltage applies the first voltage to the first electrode after raising the voltage of the first electrode through a first inductor, supplies energy to a second inductor during a first time period while maintaining the first electrode at the first voltage, and applies the second voltage to the first electrode after reducing the voltage of the first electrode through the second inductor;

and the first time period has a first duration if the load ratio is less than a predetermined value and a second duration if the load ratio is greater than the predetermined value, the first duration being shorter than the second duration.

27. A plasma display device, comprising:

a panel including a plurality of first electrodes and a plurality of second electrodes, and a panel capacitor being formed by a first electrode and a second electrode;

a means for applying a first voltage and a second voltage to the first electrode in turn; and a means for calculating a load ratio from video signals and controlling an operation of the first driver, wherein the means for applying includes:

at least one inductor having a first end coupled to the first electrode, a first switch coupled between the first electrode and a first voltage source supplying the first voltage, a second switch coupled between the first electrode and a second voltage source supplying the second voltage, a capacitor, and at least one third switch coupled between a second end of the inductor and a first end of the capacitor, or between the first end of the inductor and the first electrode, and wherein a time period where the first switch and the third switch are both turned on has a first duration if the load ratio is less than a predetermined value and a second duration if the load ratio is greater than the predetermined value, the first duration being shorter than the second duration.

* * * * *